US010569547B2

(12) United States Patent
Emi et al.

(10) Patent No.: US 10,569,547 B2
(45) Date of Patent: Feb. 25, 2020

(54) LIQUID EJECTING HEAD UNIT AND LIQUID EJECTING APPARATUS

(71) Applicant: SEIKO EPSON CORPORATION, Tokyo (JP)

(72) Inventors: Yohei Emi, Matsumoto (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/461,097

(22) Filed: Mar. 16, 2017

(65) Prior Publication Data

US 2017/0291418 A1 Oct. 12, 2017

(30) Foreign Application Priority Data

Apr. 7, 2016 (JP) ..... 2016-077591
Nov. 11, 2016 (JP) ..... 2016-220664

(51) Int. Cl.

| | |
|---|---|
| ***B41J 2/14*** | (2006.01) |
| ***B41J 2/15*** | (2006.01) |
| ***B41J 2/155*** | (2006.01) |
| ***B41J 2/16*** | (2006.01) |

(52) U.S. Cl.

CPC . *B41J 2/15* (2013.01); *B41J 2/14* (2013.01); *B41J 2/155* (2013.01); *B41J 2/1606* (2013.01); *B41J 2202/14* (2013.01); *B41J 2202/19* (2013.01); *B41J 2202/20* (2013.01)

(58) Field of Classification Search

CPC ... B41J 2/15; B41J 2/1606; B41J 2/155; B41J 2202/20; B41J 2202/19; B41J 2202/14; B41J 2/14

See application file for complete search history.

(56) References Cited

U.S. PATENT DOCUMENTS

2003/0090540 A1* 5/2003 Shimizu ..... B41J 2/14209 347/49
2007/0046727 A1* 3/2007 Yanagisawa ..... B41J 2/14024 347/47

FOREIGN PATENT DOCUMENTS

| | | |
|---|---|---|
| JP | 2002-144576 | 5/2002 |
| JP | 2007-090856 | 4/2007 |
| JP | 2015-217516 | 12/2015 |

* cited by examiner

*Primary Examiner* — Yaovi M Ameh
(74) *Attorney, Agent, or Firm* — Workman Nydegger

(57) ABSTRACT

A liquid ejecting head unit that ejects a liquid from a nozzle, the liquid ejecting head unit including a driving portion that includes an ejection surface on which a plurality of nozzles that eject the liquid are formed; a fixing plate to which a plurality of the driving portions are fixed, and a holder that (Condition 1) is fixed to a support body, which supports the liquid ejecting head unit, and the holder has a conductive property that electrically connects the support body and the fixing plate to one another, or that (Condition 2) includes a portion that projects from the fixing plate in a direction orthogonal to the ejection surface, and houses the plurality of driving portions.

21 Claims, 11 Drawing Sheets

LIQUID EJECTING HEAD UNIT AND LIQUID EJECTING APPARATUS

The entire disclosure of Japanese Patent Application No.: 2016-077591, filed Apr. 7, 2016 and 2016-220664, filed Nov. 11, 2016 are expressly incorporated by reference herein.

BACKGROUND

1. Technical Field

The present invention relates to a liquid ejecting head unit and a liquid ejecting apparatus that eject a liquid from a nozzle, and in particular, relates to an ink jet type recording head unit and an ink jet type recording apparatus that eject an ink as a liquid.

2. Related Art

An ink jet type recording head unit that discharges an ink is a representative example of a liquid ejecting head unit. An ink jet type recording head unit is provided with a plurality of ink jet type recording heads, which are driving portions that discharge ink, a holder that holds the ink jet type recording heads, and a fixing plate, which is provided on a liquid ejecting surface side of the ink jet type recording head (for example, refer to JP-A-2015-217516).

A folded portion, which projects toward an outer side, is provided on a fixing plate of such an ink jet type recording head unit, and grounding is performed as a result of the folded portion of the fixing plate and a carriage being electrically connected to one another due to being brought into contact with one another by mounting the ink jet type recording head unit on the carriage, which is a support body.

However, in a case in which grounding is performed via the folded portion, conduction is unstable as a result of deformation of the folded portion due to ascending and descending of the ink jet type recording head unit with respect to the carriage, attachment of ink to a portion at which the folded portion and the carriage come into contact with one another, and the like, and therefore, there is a problem in that grounding of the fixing plate is not performed sufficiently.

In addition, an external force arises in the ink jet type recording head unit as a result of abutting against the carriage due to a biasing force of the folded portion, and therefore, there is a problem in that a shift in the positions at which ink is deposited occurs due to a positional shift of the ink jet type recording head unit with respect to the carriage.

Additionally, this kind of problem is not limited to an ink jet type recording head unit, and is also applicable to liquid ejecting head units that eject liquids other than ink.

SUMMARY

An advantage of some aspects of the invention is to provide a liquid ejecting head unit and a liquid ejecting apparatus that can suppress a shift in the positions at which ink is deposited, or to provide a liquid ejecting head unit and a liquid ejecting apparatus that can reliably ground a fixing plate and can suppress a positional shift with respect to a support body.

According to an aspect of the invention, there is provided a liquid ejecting head unit that ejects a liquid from a nozzle, the liquid ejecting head unit including a driving portion that includes an ejection surface on which a plurality of nozzles that eject the liquid are formed, a fixing plate to which a plurality of the driving portions are fixed, and a holder that is fixed to a support body, which supports the liquid ejecting head unit, and the holder has a conductive property that electrically connects the support body and the fixing plate to one another.

In the aspect, since it is possible to electrically connect the fixing plate and the support body to one another via the holder, it is possible to easily ground the fixing plate by grounding the support body. In addition, since it is not necessary to cause a member for grounding the fixing plate to abut against the outer periphery of the fixing plate with a predetermined pressure, which the fixing plate is subjected to from the outer peripheral side thereof, a so-called external force is not generated, and therefore, it is possible to suppress a positional shift of the fixing plate and the liquid ejecting head unit in response to the external force. Furthermore, since it is not necessary to cause a grounding member for the fixing plate to abut against the outer periphery of the fixing plate with a predetermined pressure, it is possible to suppress grounding faults by suppressing electrical connection faults that are caused by repeated attachment and detachment of the liquid ejecting head unit to and from the support body. In addition, it is possible to suppress grounding faults by suppressing electrical connection faults that arise as a result of ink becoming attached to the outer periphery of the fixing plate, a member that comes into contact with the outer periphery of the fixing plate in order to ground the fixing plate, or the like.

In the liquid ejecting head unit, it is preferable that the holder include a convex portion that abuts against the fixing plate, and an adhering surface for fixing to the fixing plate. According to such a configuration, it is possible to easily fix the holder and the fixing plate by using adhesion, and it is possible to reliably electrically connect the holder and the fixing plate to one another by using the convex portion.

In addition, it is preferable that the fixing plate include a liquid repelling region, on which a liquid repelling film is formed, and a non-liquid repelling region, on which the liquid repelling film is not formed, on a side that is opposite to a surface that abuts against the convex portion, and that the non-liquid repelling region be at a position at which the convex portion abuts against the fixing plate when viewed in the direction orthogonal to the ejection surface. According to such a configuration, it is possible to suppress the fixing plate from becoming deformed as a result of the fixing plate being adhered to the holder in a state in which the non-liquid repelling region is supported. In addition, as a result of a support tool supporting the non-liquid repelling region of the fixing plate, it is possible to suppress cracking in the liquid repelling film and peeling that originates at cracks, which arise as a result of the support tool abutting against the liquid repelling film.

In addition, it is preferable that, in the fixing plate, the liquid repelling film not be formed at a position that abuts against the convex portion. According to such a configuration, in a case in which a liquid repelling film having an insulating property is used, it is possible to reliably electrically connect the fixing plate and the convex portion to one another.

In addition, it is preferable that the holder house the plurality of driving portions between itself and the fixing plate. According to such a configuration, since it is possible to protect the driving portions by using the holder, it is possible to easily attach and detach the liquid ejecting head units to and from the support body.

In addition, it is preferable that the holder include a through hole that passes therethrough in the direction orthogonal to the ejection surface, and that the plurality of driving portions include two driving portions that are disposed at positions at which the through hole is interposed therebetween when viewed in the direction orthogonal to the ejection surface. According to such a configuration, it is possible to dissipate heat from the driving portions by using the hole.

In addition, it is preferable that the holder be open on the side of the fixing plate and include a concave-shaped sensor housing portion that houses a temperature sensor, which measures a temperature of the fixing plate, and that wiring connected to the temperature sensor be disposed through the through hole. According to such a configuration, since the wiring connected to the temperature sensor is not exposed to an outer portion, it is possible to suppress the wiring from becoming disconnected. In addition, since the wiring is not exposed to the outer portion, it is possible to suppress breaking of a sensor that arises as a result of a liquid by suppressing liquid from entering the sensor housing portion via wiring exposed to the outer portion.

In addition, it is preferable that the holder be at a position at which the fixing plate is provided in the direction orthogonal to the ejection surface. According to such a configuration, it is possible to suppress the fixing plate from deforming and peeling by suppressing the ejection target medium from colliding with the fixing plate.

In addition, it is preferable that the holder include a portion that projects from the fixing plate, and a portion that does not project from the fixing plate, in the direction orthogonal to the ejection surface, that the portion that projects be provided in a direction that intersects a relative movement direction of an ejection target medium and the liquid ejecting head unit, and that the portion that does not project be provided in the relative movement direction of the ejection target medium and the liquid ejecting head unit. According to such a configuration, as a result of the portion of the holder that projects from the fixing plate, it is possible to suppress the fixing plate from deforming or breaking due to a collision with the ejection target medium. In addition, when the ejection surface is wiped in the relative movement direction by using a wiper, as a result of the portion of the holder that does not project from the fixing plate, it is possible to suppress incomplete wiping and splashing from occurring.

In addition, it is preferable that a strength of the holder be greater than a strength of the fixing plate. According to such a configuration, the liquid ejecting head unit is easy to attach and detach to and from the support body.

In addition, it is preferable that the liquid ejecting head unit further include a reinforcement plate stacked on the fixing plate, and having a strength greater than a strength of the fixing plate, which is conductive, and that the holder be electrically connected to the fixing plate via the reinforcement plate. According to such a configuration, it is possible to reinforce the fixing plate by using the reinforcement plate, and therefore, it is possible to suppress the fixing plate from deforming, and the like.

Furthermore, according to another aspect of the invention, there is provided a liquid ejecting apparatus including a plurality of the liquid ejecting head units according to the above-mentioned aspects, and the support body that supports the plurality of liquid ejecting head units.

In the aspect, it is possible to reliably ground the fixing plate via the support body, and it is possible to realize a liquid ejecting apparatus in which positional shift of the liquid ejecting head units with respect to the support body is suppressed.

According to still another aspect of the invention, there is provided a liquid ejecting head unit that ejects a liquid from a nozzle, the liquid ejecting head unit including a driving portion that includes an ejection surface on which a plurality of nozzles that eject the liquid are formed, a fixing plate to which a plurality of the driving portions are fixed, and a holder that includes a portion that projects from the fixing plate in a direction orthogonal to the ejection surface, and houses the plurality of driving portions.

In the aspect, as a result of the portion of the holder that projects from the fixing plate, it is possible to suppress the fixing plate from deforming or breaking due to a collision with the ejection target medium. As a result, it is possible to suppress a shift in the positions at which the liquid is deposited deforming or breaking the fixing plate.

In addition, it is preferable that a strength of the holder be greater than a strength of the fixing plate. According to such a configuration, as a result of the portion of the holder that projects from the fixing plate, it is possible to more effectively suppress the fixing plate from deforming or breaking due to a collision with the ejection target medium.

In addition, it is preferable that the liquid ejecting head unit further include a reinforcement plate stacked on the fixing plate, and having a strength greater than a strength of the fixing plate, and that the holder be fixed to the fixing plate via the reinforcement plate. According to such a configuration, it is possible to reinforce the fixing plate by using the reinforcement plate, and therefore, it is possible to suppress the fixing plate from deforming, and the like.

In addition, it is preferable that the holder include a portion that does not project from the fixing plate, in the direction orthogonal to the ejection surface, that the portion that projects be provided in a direction that intersects a relative movement direction of an ejection target medium and the liquid ejecting head unit, and that the portion that does not project be provided in the relative movement direction of the ejection target medium and the liquid ejecting head unit. According to such a configuration, as a result of the portion of the holder that projects from the fixing plate, it is possible to suppress the fixing plate from deforming or breaking due to a collision with the ejection target medium. In addition, when the ejection surface is wiped in the relative movement direction by using a wiper, as a result of the portion of the holder that does not project from the fixing plate, it is possible to suppress incomplete wiping and splashing from occurring. It is possible to reinforce the fixing plate by using the reinforcement plate, and therefore, it is possible to suppress the fixing plate from deforming, and the like.

Furthermore, according to still another aspect of the invention, there is provided a liquid ejecting apparatus including a plurality of the liquid ejecting head units according to the above-mentioned aspect and a support body that supports the plurality of liquid ejecting head units by using the holder.

In the aspect, it is possible to realize a liquid ejecting apparatus in which positional shift of the liquid ejecting head units with respect to the support body is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described on the basis of the embodiments.

Embodiment 1

Figure 1:
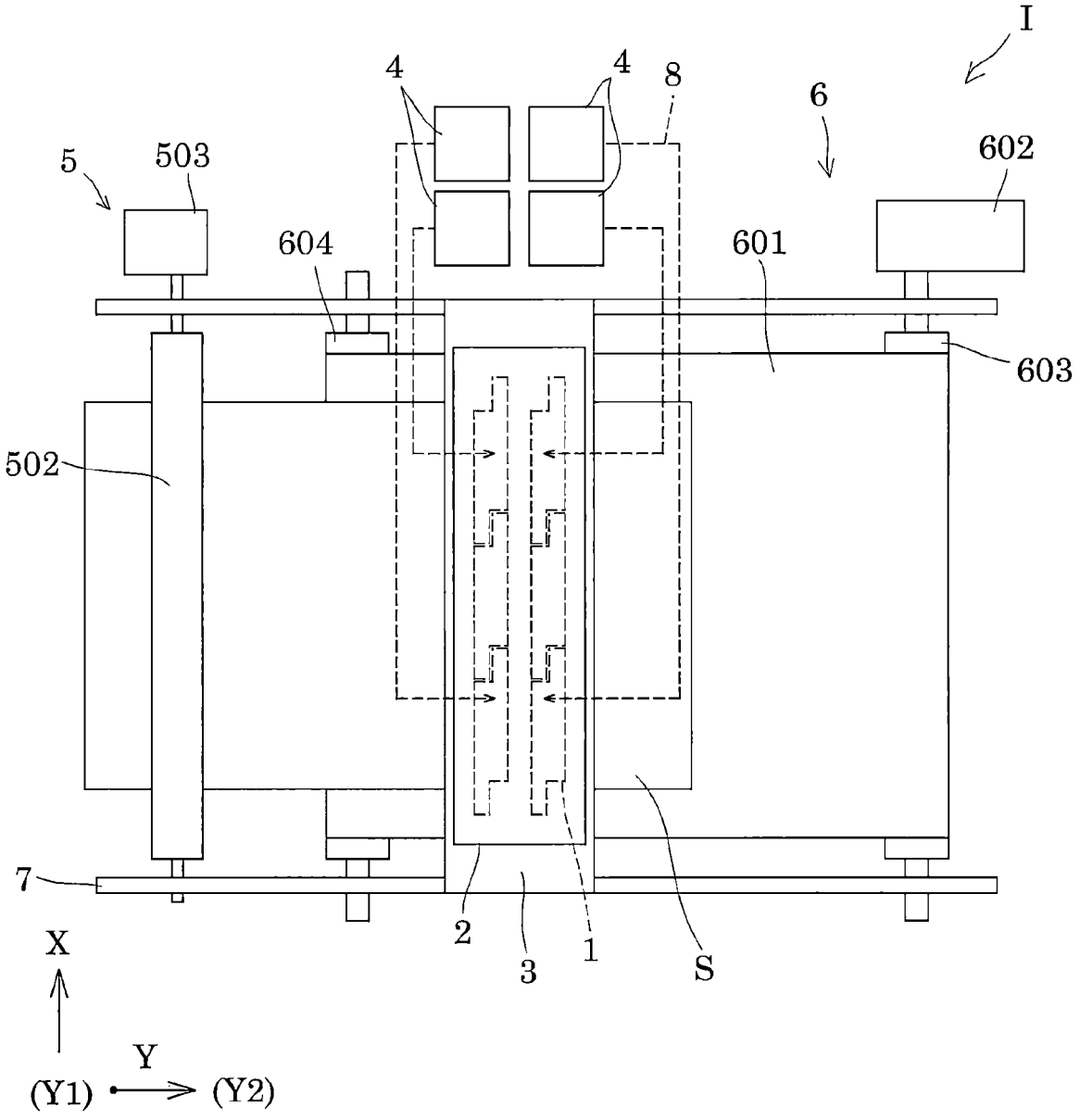
FIG. 1 is an upper surface view that shows a schematic configuration of a recording apparatus according to Embodiment 1 of the invention.
Figure 2:
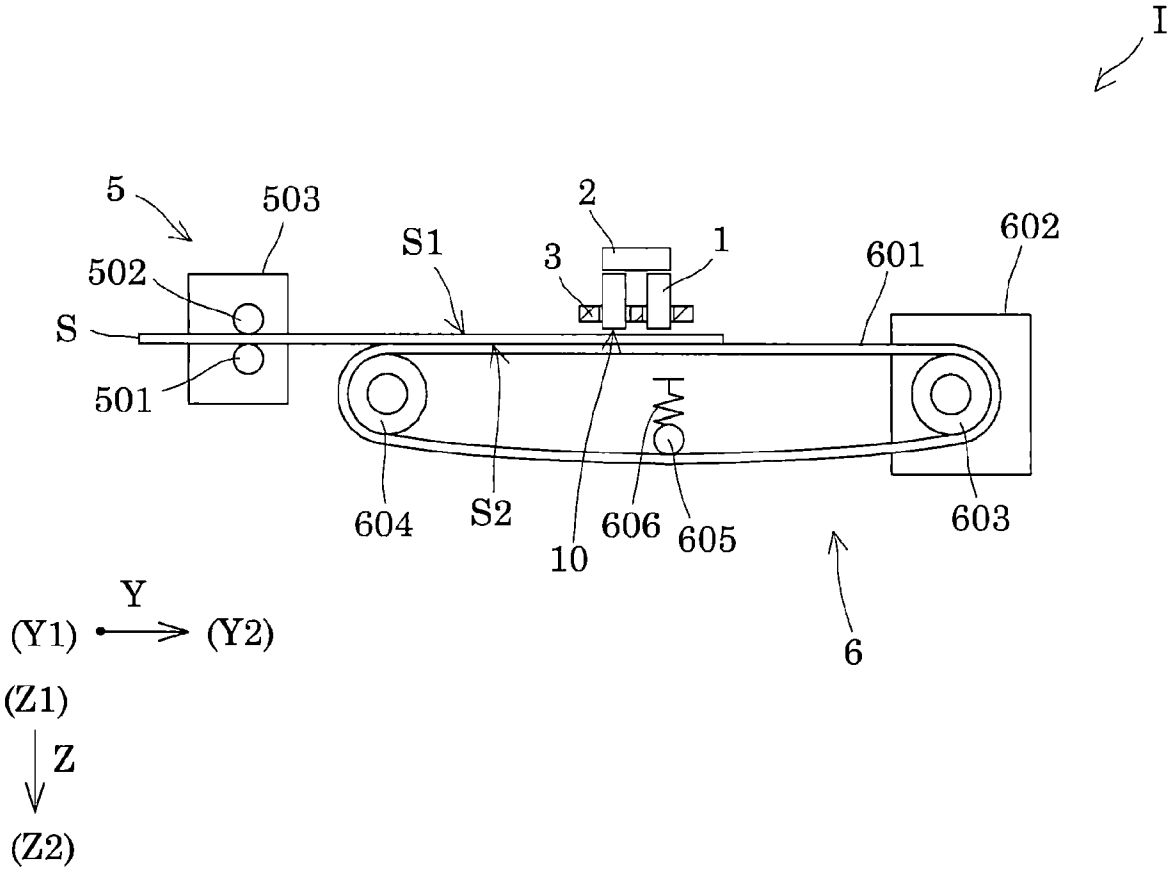
FIG. 2 is a side surface view that shows a schematic configuration of the recording apparatus according to Embodiment 1 of the invention.

FIG. 1 is an upper surface view that shows a schematic configuration of an ink jet type recording apparatus, which is an example of a liquid ejecting apparatus according to Embodiment 1 of the invention, and FIG. 2 is a side surface view that shows a schematic configuration of the ink jet type recording apparatus.

An ink jet type recording apparatus I of the illustrated present embodiment is a so-called line-type ink jet type recording apparatus that performs printing by merely transporting recording sheets S, which are an ejection target medium.

The ink jet type recording apparatus I is provided with a plurality of ink jet type recording head units 1 (hereinafter, also referred to as head units 1), a supply member 2 that supplies an ink to the plurality of head units 1, a support body 3 that supports the plurality of head units 1, a liquid retention unit 4 such as an ink tank in which the ink is retained, and an apparatus main body 7.

The plurality of head units 1 are held in the support body 3. More specifically, a plurality, three in the present embodiment, of the head units 1 are arranged in parallel in a direction that intersects a transport direction of the recording sheets S. From this point onwards, the direction in which the head units 1 are arranged in parallel will be referred to as a first direction X. In addition, a plurality, two in the present embodiment, of rows in which the head units 1 are arranged in parallel in the first direction X are linearly arranged in the support body 3 in the transport direction of the recording sheets S. The direction in which the rows of the head units 1 are linearly arranged will be referred to as a second direction Y, and in the second direction Y, the upstream side in the transport direction of the recording sheets S will be referred to as a Y1 side while the downstream side will be referred to as a Y2 side. Furthermore, in the present embodiment, a direction orthogonal to both the first direction X and the second direction Y will be referred to as a third direction Z, the head unit 1 side will be referred to as a Z1 side, and the recording sheet S side will be referred to as a Z2 side. Additionally, in the present embodiment, the relationship of each direction (X, Y, and Z) to each other direction is set to be orthogonal, but the embodiment is not necessarily limited to the arrangement relationship of each configuration being orthogonal. The support body 3, which supports such head units 1, is fixed to an apparatus main body 7. In addition, the supply member 2 is fixed to the plurality of head units 1, which are held by the support body 3. The ink supplied from the supply member 2 is supplied to the head units 1.

The liquid retention unit 4 is composed of a tank in which the ink, as a liquid, is retained, and in the present embodiment, is fixed to the apparatus main body 7. The ink from the liquid retention unit 4, which is fixed to the apparatus main body 7, is supplied to the supply member 2 via a supply pipe 8 such as a tube, and the ink supplied to the supply member 2 is supplied to the head units 1. Additionally, an aspect in which the supply member 2 of the head unit 1 is provided with the liquid retention unit 4, for example, in which a liquid retention unit 4 such as an ink cartridge is mounted on the Z1 side in the third direction Z of the supply member 2, may also be applied.

In addition, the ink jet type recording apparatus I may also be provided with a transport unit. A first transport unit 5, as an example of a transport unit, is provided on the Y1 side in the second direction Y. The first transport unit 5 is provided with a first transport roller 501 and a first driven roller 502, which is driven by the first transport roller 501. The first transport roller 501 is provided on a rear surface S2 side of the recording sheets S, a side that is opposite to a depositing surface S1 onto which ink the ink is deposited, and is driven by a driving force of a first driving motor 503. In addition, the first driven roller 502 is provided on the depositing surface S1 side of the recording sheets S, and the recording sheets S are held between itself and the first transport roller 501. Such a first driven roller 502 presses the recording sheets S toward the first transport roller 501 side by using a biasing member such as a spring, which is not illustrated in the drawings.

A second transport unit 6, as an example of a transport unit, is provided on the Y2 side, which is further than the first transport unit 5 on the downstream side, and is provided with a transport belt 601, a second driving motor 602, a second transport roller 603, a second driven roller 604, and a tension roller 605.

The second transport roller 603 is driven by the driving force of the second driving motor 602. The transport belt 601 is composed of an endless belt and is placed around the outer periphery of the second transport roller 603 and the second driven roller 604. Such as transport belt 601 is provided on the rear surface S2 side of the recording sheets S. The tension roller 605 is provided between the second transport roller 603 and the second driven roller 604, abuts against the inner peripheral surface of the transport belt 601, and applies a tensile force to the transport belt 601 by using a biasing force of a biasing member 606 such as a spring. As a result, in the transport belt 601, a surface that faces the head units 1 is flat between the second transport roller 603 and the second driven roller 604.

In such an ink jet type recording apparatus I, printing is performed by ejecting the ink from the head units 1 and depositing the ejected ink on the depositing surface S1 of the recording sheets S while transporting the recording sheets S toward the Y2 side from the Y1 side in the second direction Y with respect to the head units 1 by using the first transport unit 5 and the second transport unit 6. The transport units are not limited to the above-mentioned first transport unit 5 and second transport unit 6, and a transport unit using a so-called drum, a transport unit that is provided with a platen, or the like, may also be used.

Figure 5:
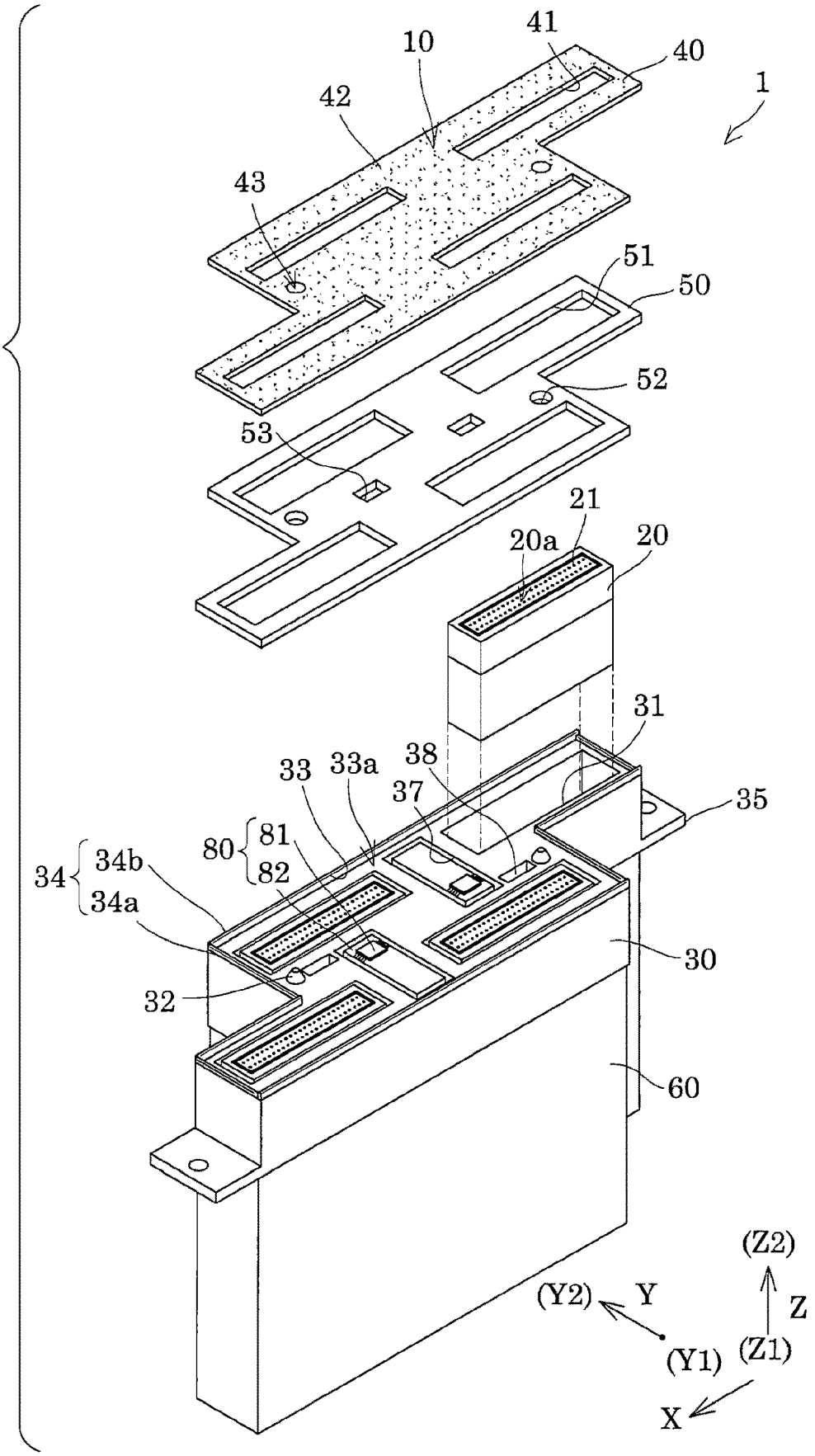
FIG. 5 is an exploded perspective view of the head unit according to Embodiment 1 of the invention.
Figure 6:
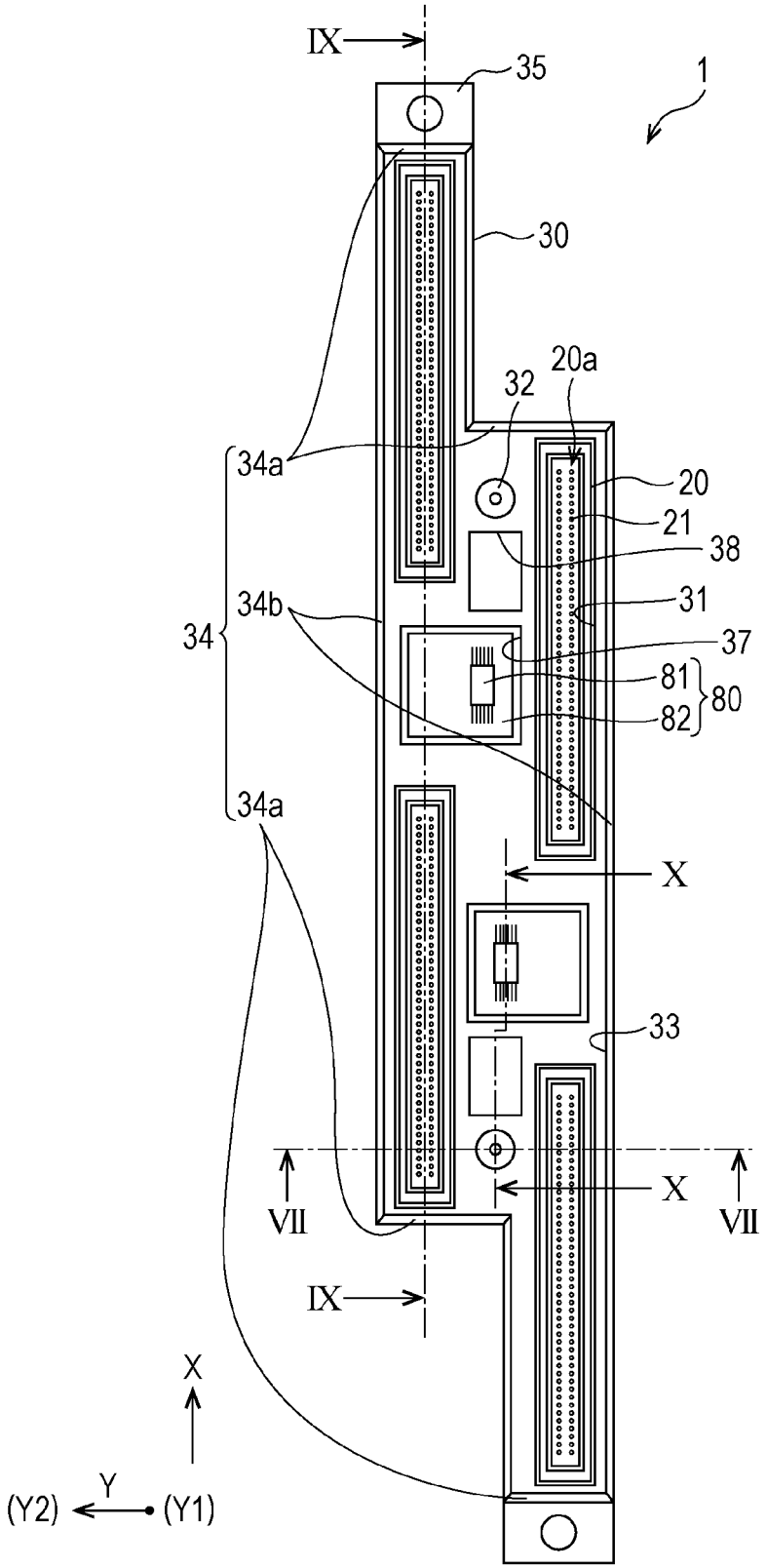
FIG. 6 is a main portion bottom surface view of the head unit according to Embodiment 1 of the invention.
Figure 7:
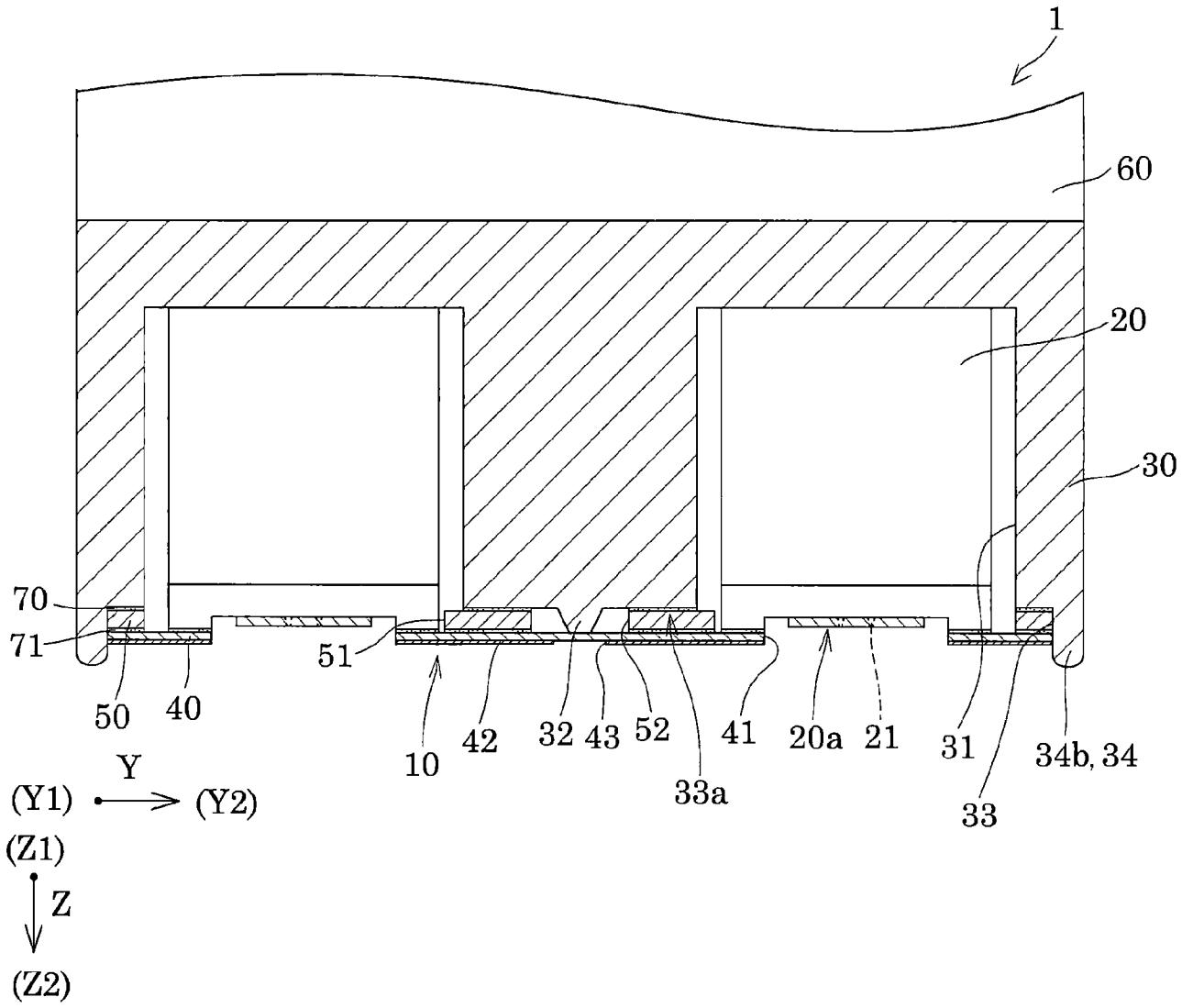
FIG. 7 is a main portion cross-sectional view of the head unit according to Embodiment 1 of the invention.
Figure 8:
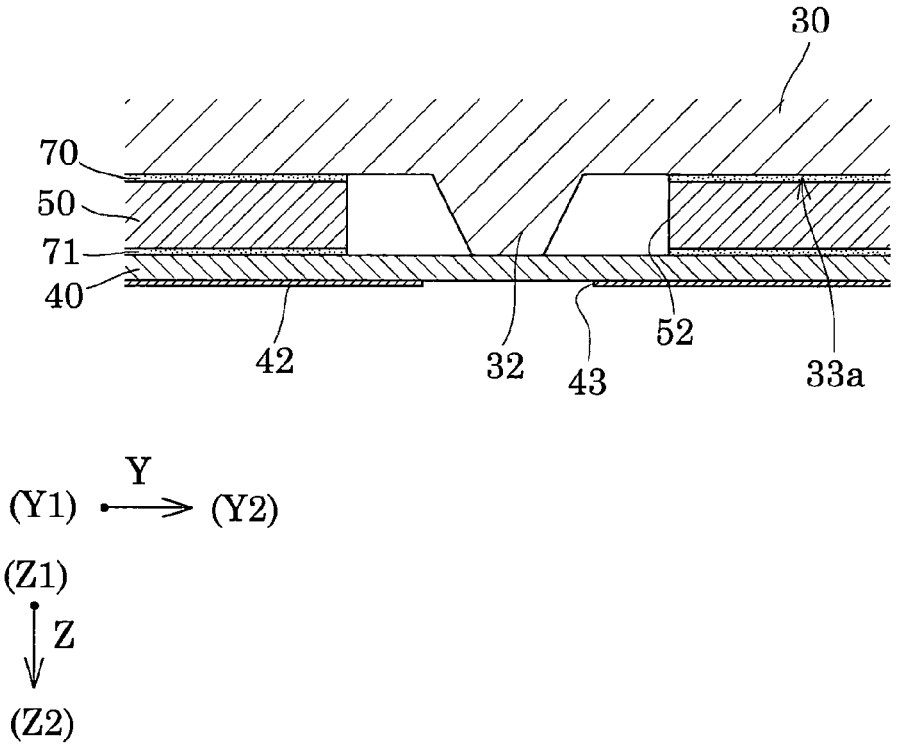
FIG. 8 is a cross-sectional view of the head unit according to Embodiment 1 of the invention in which the main portions are enlarged.
Figure 9:
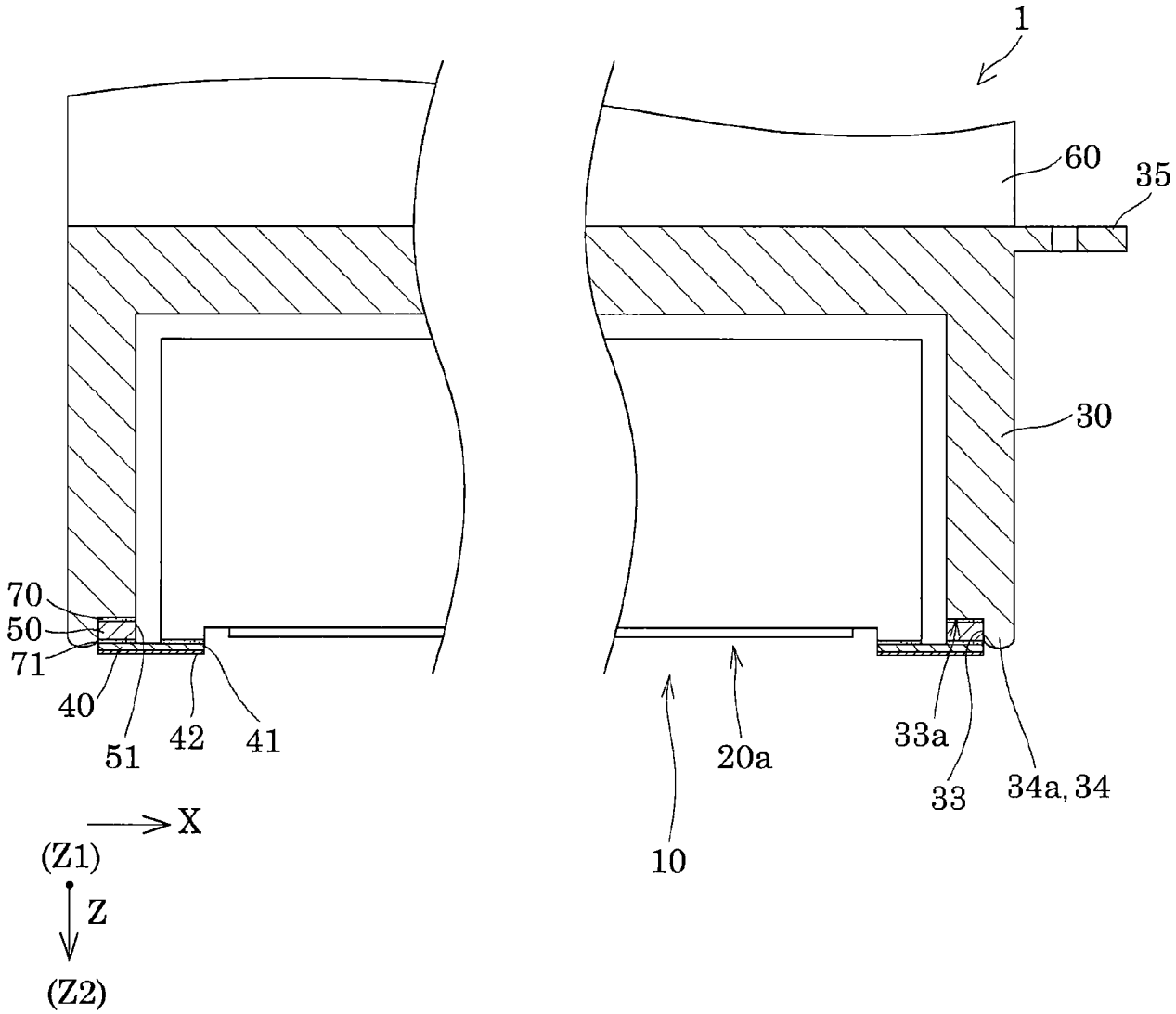
FIG. 9 is a main portion cross-sectional view of the head unit according to Embodiment 1 of the invention.
Figure 10:
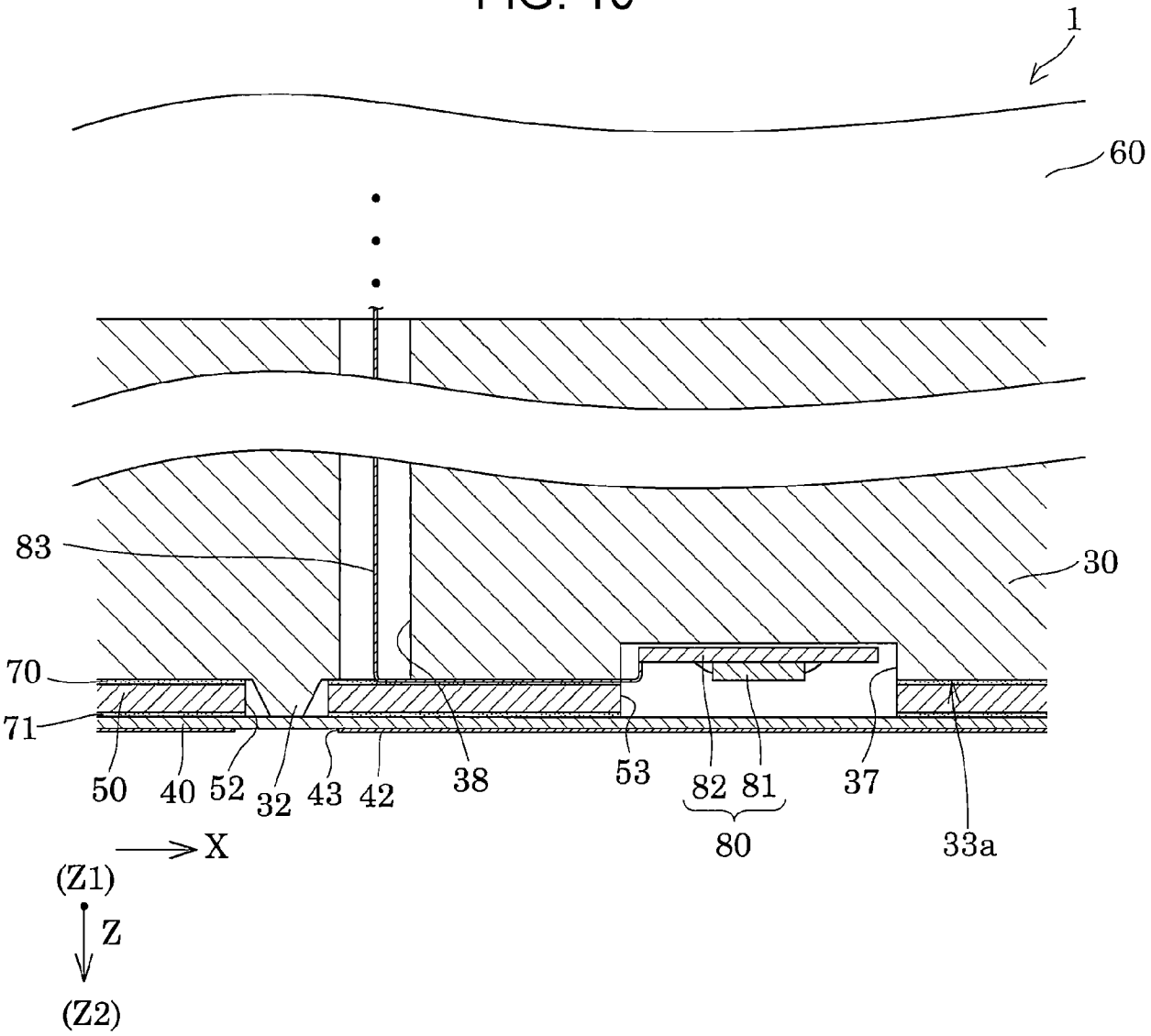
FIG. 10 is a main portion cross-sectional view of the head unit according to Embodiment 1 of the invention.

In this instance, the head unit 1 will be described in further detail with reference to FIGS. 3 to 9. Additionally, FIG. 3 is an exploded perspective view of a head unit and a support body, FIG. 4 is an upper surface view of the head unit and the support body, FIG. 5 is an exploded perspective view of the head unit, FIG. 6 is a main portion plan view of the head unit, FIG. 7 is a cross-sectional view taken along line VII-VII in FIG. 6, FIG. 8 is a view in which the main portions of FIG. 7 are enlarged, FIG. 9 is a cross-sectional taken along line IX-IX of FIG. 6, and FIG. 10 is a cross-sectional view taken along line X-X of FIG. 6.

Figure 3:
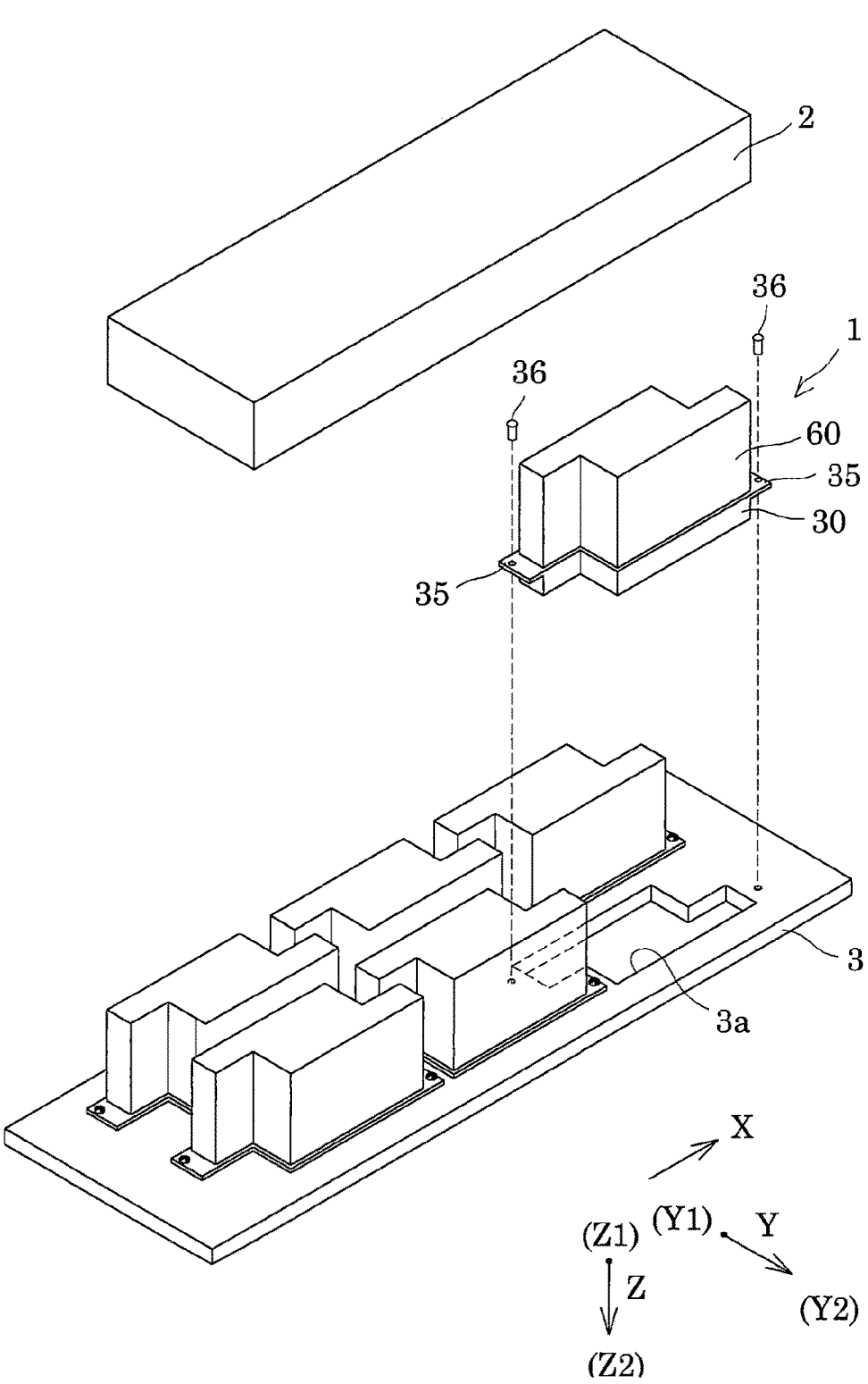
FIG. 3 is an exploded perspective view of a head unit and a support body according to Embodiment 1 of the invention.
Figure 4:
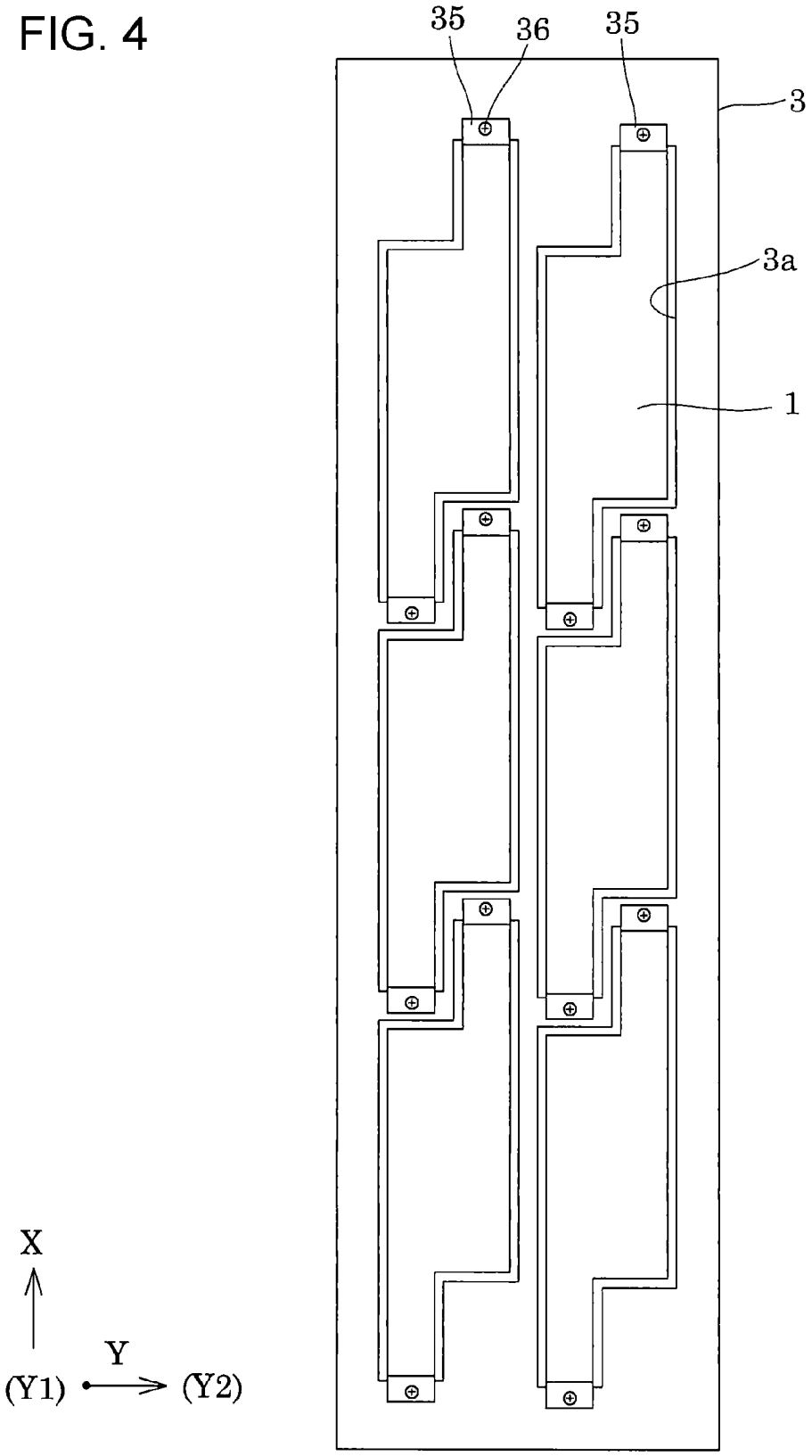
FIG. 4 is an upper surface view of the head unit and the support body according to Embodiment 1 of the invention.

As shown in FIGS. 3 and 4, the support body 3, which supported the plurality of head units 1, is composed of a plate form member that is formed by using a conductive material such as a metal. Support holes 3*a* for holding each head unit 1 are provided in the support body 3. In the present embodiment, the support holes 3*a* are provided independently for each head unit 1. Naturally, a support hole 3*a* may be continuously provided throughout the entirety of the plurality of head units 1.

The head units 1 are held inside the support holes 3*a* of such a support body 3 in a state in which ejection surfaces 10 project from a surface on the Z2 side of the support body 3. Additionally, in the present embodiment, among surfaces of the head units 1, surfaces that face the recording sheets S will be referred to as the ejection surfaces 10.

In addition, in the above-mentioned manner, as shown in FIG. 4, two rows in which a plurality, three in the present embodiment, of the head units 1 that are held by the support body 3 are arranged in parallel in the first direction X, are linearly arranged in the second direction Y.

In this instance, as shown in FIG. 5, the head units 1 are provided with a plurality of driving portions 20, which include nozzles that eject the ink, a holder 30 that holds the plurality of driving portions 20, a fixing plate 40 that fixes the plurality of driving portions 20, a reinforcement plate 50 that reinforces the fixing plate 40, and a flow channel member 60 that supplies the ink the driving portions 20.

As shown in FIG. 6, nozzles 21, which eject the ink, are arranged in parallel along the first direction X in the driving portions 20. In addition, a plurality, two in the present embodiment, of rows in which the nozzles 21 are arranged in parallel in the first direction X are linearly arranged in the driving portions 20 in the second direction Y.

A flow channel that is in communication with the nozzles 21, and a pressure generation unit that brings about a change in pressure change in the ink inside the flow channel are provided in the inner portions, which are not illustrated in the drawings, of the driving portions 20. As the pressure generation unit, it is possible to use a component that causes ink droplets to be discharged from the nozzles 21 by bringing about a pressure change in the ink inside the flow channel as a result of changing the capacity of the flow channel due the deformation of a piezoelectric actuator, which includes a piezoelectric material that exhibits an electromechanical conversion function, a component that causes ink droplets to be discharged from the nozzles 21 by using bubbles that are generated by using heat emission of a heat-emitting element, an electrostatic actuator that causes ink droplets to be discharged from the nozzles 21 by causing a vibration plate to deform by using an electrostatic force as a result of generating an electrostatic force between the vibration plate and an electrode, or the like. Additionally, among surfaces of the driving portions 20, surfaces in which the nozzles 21 are open are nozzle surfaces 20*a*. That is, the nozzle surfaces 20*a*, on which the nozzles 21 are formed, are included in the ejection surfaces 10 of the head units 1.

As shown in FIGS. 6, 7, and 8, the holder 30 is composed of a conductive material such as a metal. In addition, the holder 30 has a strength that is greater than the strength of the fixing plate 40. Housing portions 31, which house the plurality of driving portions 20, are provided on a surface on the Z2 side in the third direction Z of the holder 30. The housing portions 31 have a concave shape that is open on one side in the third direction Z, and house the plurality of driving portions 20, which are fixed by the fixing plate 40. In addition, the opening of the housing portion 31 is sealed by the fixing plate 40. That is, the driving portions 20 are housed in the inner portions of spaces that are formed by the housing portions 31 and the fixing plate 40. Additionally, a housing portion 31 may be provided for each driving portion 20, or may be continuously provided throughout the entirety of the plurality of driving portions 20. In the present embodiment, a configuration in which the housing portions 31 are provided independently for each driving portion 20 is used.

The driving portions 20 are disposed in such a holder 30 in a staggered manner along the first direction X. In this instance, the driving portions 20 being disposed in a staggered manner along the first direction X refers the fact driving portions 20, which are arranged in parallel in the first direction X, are disposed alternately shifted in the second direction Y. That is to say that two rows of the driving portions 20, which are arranged in parallel in the first direction X, are arranged in parallel in the second direction Y, and the two rows of the driving portions 20 by half pitch in the first direction X. As a result of disposing the driving portions 20 in a staggered manner along the first direction X in this manner, it is possible to form rows of the nozzles 21 that are continuous throughout the first direction X due to the nozzles 21 of two driving portions 20 partially overlapping in the first direction X.

In addition, convex portions 32, which project toward the fixing plate 40, are provided on the surface of the Z2 side of the holder 30. The convex portions 32 are provided between housing portions 31 that house two driving portions 20 that are arranged in parallel in the second direction Y. In the present embodiment, a configuration in which two convex portions 32 are provided is used.

The convex portions 32 have a truncated cone-shaped the width of which that gradually narrows toward the tip end that projects, that is, toward the Z2 side. Additionally, the shape of the convex portions 32 is not particularly limited, and may be a columnar shape, or may be a rectangular shape, or the like. The holder 30 and the fixing plate 40 are electrically connected to one another as a result of the tip end surfaces of such convex portions 32 coming into contact with the fixing plate 40. Incidentally, in the present embodiment, the tip end surfaces of the convex portions 32 and the fixing plate 40 come into surface contact with one another as a result of the tip end surfaces of the convex portions 32 being configured as flat surfaces. As a result of this, a contact area of the convex portions 32 and the fixing plate 40 is secured and it is possible to suppress the resistance in a connection portion from becoming high. That is, when the convex portions 32 come into point contact with the fixing plate 40, the contact area thereof is small, the electrical connection is insufficient, and there is a concern that grounding of the fixing plate 40, which will be mentioned in more detail later, will be insufficient.

In addition, as shown in FIGS. 6, 7, and 8, a concave portion 33, which has a concave shape to which the reinforcement plate 50 and the fixing plate 40 are fixed, is provided on the surface of the Z2 side of the holder 30 on which the housing portions 31 are provided. That is, outer peripheral edge portions of the surface of the Z2 side of the holder 30 correspond to edge portions 34 provided projecting on the Z2 side, and the concave portion 33 is formed by the edge portions 34, which project on the Z2 side. The reinforcement plate 50 and the fixing plate 40 are sequentially stacked on the bottom surface of the concave portion 33. In the present embodiment, a configuration in which the bottom surface of the concave portion 33 of the holder 30 and the reinforcement plate 50 are bonded by using a first adhesive 70, and the reinforcement plate 50 and the fixing plate 40 are bonded by using a second adhesive 71 is used. That is, among the bottom surface of the concave portion 33 of the holder 30, portions other than the convex portions 32 are configured as adhesion surfaces 33*a*, to which the fixing plate 40 is adhered. In the present embodiment, the adhesion surfaces 33*a* of the holder 30 are bonded to the fixing plate 40 via the reinforcement plate 50. Additionally, in a case in which the reinforcement plate 50 is not provided, the adhesion surfaces 33*a* of the holder 30 are directly bonded to the fixing plate 40. In other words, the adhesion surfaces 33*a* of the holder 30, which are bonded to the fixing plate 40, include surfaces that are directly bonded to the fixing plate 40, and surfaces that are bonded via the reinforcement plate 50. In addition, a gap of an amount corresponding to an amount that is required in bonding is provided between the adhesion surfaces 33*a* and the fixing plate 40, and the two components do not abut against one another. In this manner, it is possible to easily fix the two components by bonding the adhesion surfaces 33*a* of the holder 30 and the fixing plate 40.

In this instance, as shown in FIG. 6, among the edge portions 34, two first edge portions 34*a*, which are provided in a direction that follows the second direction Y, which is a direction in which the recording sheets S and the head unit 1 are relatively moved, are provided in a manner that does not project further than the fixing plate 40, which is fixed to the concave portion 33, as shown in FIG. 9. That is, among the fixing plate 40, at least the surface on the Z2 side is provided projecting further on the Z2 side than the first edge portions 34*a*. In addition, as shown in FIG. 6, among the edge portions 34, two second edge portions 34*b*, which are provided in a direction that follows the first direction X, which is a direction that intersects the second direction Y, which is a relative movement direction of the recording sheets S, are provided projecting on the Z2 side further than the fixing plate 40, which is fixed to the concave portion 33 as shown in FIG. 7.

As a result of the second edge portions 34*b* projecting on the Z2 side further than the fixing plate 40, it is possible to suppress the occurrence of deformation and peeling of the fixing plate 40 due to the recording sheets S coming into contact with the side surfaces of the fixing plate 40 during relative movement of the recording sheets S and the head units 1, that is, during transport of the recording sheets S. In addition, as a result of the first edge portions 34*a* not projecting further than the fixing plate 40, it is possible to suppress wiping faults such as incomplete wiping and the occurrence of splashing during wiping by suppress a wiper from coming into contact with the first edge portions 34*a* during wiping of the fixing plate 40.

Additionally, the first edge portions 34*a* and the second edge portions 34*b* of the present embodiment are present at positions in which the fixing plate 40 is provided in the third direction Z. That is, the first edge portions 34*a* do not project further than the surface on the Z2 side of the fixing plate 40, but are disposed extending further on the Z2 side than the surface on the Z1 side of the fixing plate 40. Therefore, even in the case of the first edge portions 34*a*, it is possible to suppress the fixing plate 40 and the reinforcement plate 50 from peeling by protecting the side surfaces of the fixing plate 40, and in particular, the bonding surface of the fixing plate 40 and the reinforcement plate 50, and the bonding surface of the fixing plate 40 and the holder 30. That is, it is preferable that the edge portions 34 be at positions in which the fixing plate 40 is provided in the third direction Z.

In addition, in the present embodiment, among the edge portions 34, a configuration in which the first edge portions 34*a* do not project further than the fixing plate 40 is used, but the configuration is not particularly limited, and the first edge portions 34*a* may project further on the Z2 side than the fixing plate 40. In addition, a configuration in which the second edge portions 34*b* on the Y1 side and the Y2 side of the head units 1 project further on the Z2 side than the fixing plate 40 is used, but the configuration is not particularly limited, and the second edge portions 34*b* on at least the Y1 side, which is on the upstream side in the transport direction of the recording sheets S, may project further on the Z2 side than the fixing plate 40. That is, since it is possible to prevent collision of the recording sheets S with the fixing plate 40 during transport by using the first edge portions 34*a* on the Y1 side, the second edge portions 34*b* on the Y2 side need not necessarily project further than the fixing plate 40.

In this instance, as shown in FIGS. 5, 7, and 9, the fixing plate 40 is composed of a plate form member, which is formed by using conductive material such as a metal. In addition, exposure opening portions 41, which expose the nozzle surface 20*a* of each driving portion 20, are provided on the fixing plate 40. In the present embodiment, the exposure opening portions 41 are provided independently for each driving portion 20. Additionally, the fixing plate 40 is fixed to the nozzle surface 20*a* sides of the driving portions 20 in peripheral portions of the exposure opening portions 41.

Such a fixing plate 40 is fixed to the inside of the concave portion 33 of the holder 30 via the reinforcement plate 50 in a manner that blocks the openings of the housing portions 31 of the holder 30.

It is preferable that the reinforcement plate 50 use a material having a strength that is greater than the strength of the fixing plate 40. In the present embodiment, a configuration in which a plate form member that is made from the same material as the fixing plate 40 and in which the plate form member is thicker in the third direction Z than the fixing plate 40 is used as the reinforcement plate 50 is used.

In addition, the opening portions 51, which have internal diameters that are greater than those of the outer peripheries of the driving portions 20, are provided in the reinforcement plate 50 passing therethrough in the third direction Z to correspond to the driving portions 20, which are joined to the fixing plate 40. The driving portions 20, which are inserted inside the opening portions 51 of the reinforcement plate 50, are joined to the surface on the Z1 side of the fixing plate 40.

In addition, insertion holes 52, into which the convex portions 32 of the holder 30 are inserted, are provided in the reinforcement plate 50 passing therethrough in the third direction Z. Further, the convex portions 32 of the holder 30, which are inserted through the insertion holes 52 of the reinforcement plate 50, abut against the surface on the Z1 side of the fixing plate 40. That is, the holder 30 and the fixing plate 40 are connected electrically, or in other words, are caused to conduct as a result of the convex portions 32 of the holder 30 and the fixing plate 40 being caused to abut against one another. Additionally, the height with which the convex portions 32 of the holder 30 project from the joining surface with the reinforcement plate 50 is greater than the thickness of the reinforcement plate 50. As a result of this, it is possible to cause the tip ends of the convex portions 32 to abut against the fixing plate 40 by projecting further on the Z2 side than the reinforcement plate 50.

In addition, as shown in FIGS. 7 and 8, among surfaces of the fixing plate 40, a liquid repelling film 42 is provided on the surface that faces the recording sheets S, that is, the surface on the Z2 side. The liquid repelling film 42 is not particularly limited as long as it has a liquid repelling property (a water repelling property) with respect to ink, and for example, it is possible to use a metal film that includes a fluorine polymer, a metal alkoxide molecular film that has a liquid repelling property, or the like. Additionally, the liquid repelling film 42 is not provided on the surface on the Z1 side of the fixing plate 40. As a result of not providing the liquid repelling film 42 on the surface on the Z1 side of the fixing plate 40, it is possible to favorably perform adhesion of the fixing plate 40, the driving portions 20, and the reinforcement plate 50. In addition, in a case in which an insulation film such as a metal alkoxide molecular film is used as the liquid repelling film 42, as a result of not providing the liquid repelling film 42 on the surface on the Z1 side of the fixing plate 40, it is possible to reliably achieve electrical connection when causing the fixing plate 40 and the convex portions 32 of the holder 30 to abut against one another. Additionally, even in a case in which a conductive film is used as the liquid repelling film 42, as a result of not providing the liquid repelling film 42 on the surface on the Z1 side of the fixing plate 40, it is possible to suppress the adhesion strength of the fixing plate 40 and the reinforcement plate 50 from being reduced.

Furthermore, non-liquid repelling regions 43, in which the liquid repelling film 42 is not provided, are provided on the surface that faces the recording sheets S on the Z2 side of the fixing plate 40 at positions that abut against the convex portions 32 of the holder 30 when viewed from the third direction Z. That is, among the surfaces on the Z2 side of the fixing plate 40, regions other than the non-liquid repelling regions 43 correspond to liquid repelling regions in which the liquid repelling film 42 is provided.

In this instance, the fixing plate 40 and the holder 30 are joined as a result of being mutually pressed with a predetermined pressure in a state in which the surface on the Z2 side of the fixing plate 40 is supported by a support tool, which is not illustrated in the drawings. Incidentally, in the present embodiment, in the fixing plate 40, joined body in which the driving portions 20, the reinforcement plate 50, and the fixing plate 40 are joined in advance, is fixed to the holder 30. At this time, it is possible to reliably cause the convex portions 32 and the surface on the Z1 side of the fixing plate 40 to abut against one another by providing the non-liquid repelling regions 43 on the fixing plate 40, causing the support tool to abut against the non-liquid repelling regions 43, and supporting portions of the fixing plate 40 against which the convex portions 32 of the holder 30 abut by using the support tool. Accordingly, it is possible to suppress the liquid repelling film 42 from cracking and peeling as a result of the liquid repelling film 42 coming into contact with the support tool. Incidentally, when the liquid repelling film 42 is provided throughout the entire surface on the Z2 side of the fixing plate 40, the support tool abuts against the liquid repelling film 42, and there is a concern that cracking, or the like, will occur in the liquid repelling film 42 and the liquid repelling film 42 will peel away originating at the cracks. In addition, in a case in which the non-liquid repelling regions 43 are disposed at positions that are separated from positions that abut against the convex portions 32 of the holder 30, or in which the surface on the Z2 side of the fixing plate is not supported by the support tool, a load is concentrated on portions of the fixing plate 40 against which the tip ends of the convex portions 32 of the holder 30 abut, and the portions of the fixing plate 40 against which the convex portions 32 abut are deformed. Cracking of the liquid repelling film 42 and peeling originating at the cracks also occurs as a result of the fixing plate 40 being deformed in this manner. In the present embodiment, as a result of providing the non-liquid repelling regions 43 on the surface on the Z2 side of the fixing plate 40 at positions against which the convex portions 32 abut when viewed from the third direction Z, and joining the fixing plate 40 and the holder 30 by supporting the non-liquid repelling regions 43 of the fixing plate 40 by using the support tool, it is possible to suppress the fixing plate 40 from deforming and the liquid repelling film 42 from cracking and peeling.

The flow channel member 60 is fixed to the Z1 side of the holder 30. In addition, a flow channel for supplying the ink to the driving portions is provided in an inner portion, which is not illustrated in the drawings, of the flow channel member 60, and the ink supplied from the supply member 2 is supplied to each driving portion 20 via the flow channel member 60. Additionally, a filter, which removes foreign matter such as contaminants or air bubbles that are included in the ink, a pressure adjustment valve, which opens and closes depending on the pressure of the flow channel on the downstream side, and the like, may also be provided in the flow channel of the flow channel member 60.

In such a head unit 1, the ink is supplied from the supply member 2 via the flow channel member 60, and ink droplets are ejected from the nozzles 21 as a result of the pressure generation units inside the driving portions 20 being driven on the basis of printing signals.

Further, as shown in FIGS. 3 and 4, a plurality of the head units 1 are held in the support body 3. In the present embodiment, flange portions 35, which are provided integrally with a holder 30, are provided on both side in the first direction X of the corresponding holder 30, and the flange portions 35 are fixed to the support body 3 by using fixing screws 36. At this time, the flange portions 35 and the support body 3 may be directly connected, or in addition, may be electrically connected by using the fixing screws 36.

In this manner, it is possible to electrically connect the fixing plate 40 and the support body 3 to one another via the holders 30 as a result of electrically connecting the holders 30 and the support body 3 to one another by fixing the holders 30 of the head units 1 to the support body 3. That is, it is possible to electrically connect the fixing plate 40 and the support body 3 to one another via the holders 30 by electrically connecting the fixing plate 40 and the holders 30 to one another and electrically connecting the holders 30 and the support body 3 to one another. In other words, the holders 30 are fixed to the support body 3, which supports the head units 1, and the holders 30 have a conductive property that electrically connects the support body 3 and the fixing plate 40 to one another.

Further, as a result of grounding the support body 3, it is possible to ground the fixing plate 40, which is electrically connected to the support body 3 via the holders 30. In this manner, as a result of grounding the fixing plate 40, which is a conductor that is disposed closest to the recording sheets S, it is possible to suppress the influence of charged recording sheets S on the head units 1, and in particular, to suppress breaking due to charging.

In addition, according to the present embodiment, since the fixing plate 40 is electrically connected to the support body 3 as a result of being electrically connected to the holders 30 in an internal manner, members, or the like, that abut against the outer periphery of the head units 1 in order to achieve electrical connection are not necessary. Accordingly, the outer peripheries of the head units 1 are not surface an external force, and it is possible to suppress a shift in the positions at which ink is deposited by suppressing positional shift, or the like, of the head units 1 due to the external force. Incidentally, the fixing plate 40 of the present embodiment being electrically connected to the holders 30 in an internal manner refers to the fact that the fixing plate 40 is electrically connected by using the inner sides of the adhesion surfaces 33*a* of the holders 30 to which the fixing plate 40 is adhered when viewed from the third direction Z.

Furthermore, in the present embodiment, by merely fixing the head units 1 to the support body 3, since it is possible to electrically connect the fixing plate 40 and the support body 3 to one another while preventing contact with the fixing plate 40 due to an external force, it is unlikely that grounding faults will occur as a result of electrical connection faults due to the repetition of attachment and detachment of the head units 1 to the support body 3. In addition, in the present embodiment, since it is possible to electrically connect the fixing plate 40 and the holder 30 to one another in an internal manner, it is unlikely that electrical connection faults will occur as a result of the ink being attached to the outer periphery of the fixing plate 40 or a member, or the like, that comes into contact with the outer periphery of the fixing plate 40 in order to ground the fixing plate 40, and therefore, it is unlikely that grounding faults will occur. Additionally, in the present embodiment, since the plurality of driving portions 20 are housed between the holders 30 and the fixing plate 40, it is possible to protect the driving portions 20 by using the holders 30 and the fixing plate 40, and therefore, it is possible to easily attach and detach the head units 1 to and from the support body 3. In particular, as a result of using a material having a strength that is greater than the strength of the fixing plate 40 as the holders 30, it is possible to easily attach and detach the head units 1 to and from the support body 3. In this instance, the plurality of driving portions 20 being housed between the holders 30 and the fixing plate 40 refers to a state in which other than the exposure for wiring of the driving portions 20 and the exposure for liquid supply, the plurality of driving portions 20 are not exposed to the outside.

In addition, in the present embodiment, as a result of merely fixing the plurality of head units 1 to the common support body 3, it is possible to ground the fixing plate 40 by using the support body 3. Accordingly, a member for grounding each head unit 1 is not necessary, and therefore, it is possible to decrease the number of parts and reduce the cost. Naturally, the support body 3 may be divided and provided for each head unit group, which is configured by a plurality of the head units 1.

Additionally, as shown in FIGS. 6 and 10, sensor housing portions 37, and a through holes 38 are provided in the holder 30 of the present embodiment.

The sensor housing portions 37 have a concave shape, which is provided open on the Z2 side on the bottom surface of the concave portion 33 of the holder 30. Temperature sensor modules 80 in which temperature sensors 81 are installed on substrates 82, are housed inside the sensor housing portions 37.

The through holes 38 are provided passing through the holder 30 in the third direction Z between two driving portions 20 that are arranged in parallel in the second direction Y. As a result of the driving portions 20 being provided on both sides in the second direction Y of the through holes 38 in this manner, it is possible to dissipate heat from the driving portions 20 via the through holes 38 of the holder 30.

In addition, sensor wiring 83, which is connected to the temperature sensor modules 80, is lead out to the Z1 side via the through holes 38. As a result of leading out the sensor wiring 83, which is connected to the temperature sensor modules 80, to the Z1 side of the holder 30 through insertion into the through holes 38, it is not necessary to lead the sensor wiring 83 around the outer periphery of the head unit 1, and in particular, the outer periphery of the holder 30, and therefore, it is possible to suppress disconnection due to the sensor wiring 83 being exposed to the outside. In addition, since it is not necessary to lead the sensor wiring 83 around the outer periphery of the head unit 1, it is possible to suppress the ink from entering the inside of the sensor housing portions 37 via the sensor wiring 83, which is provided at the outer periphery. Accordingly, it is possible to suppress the temperature sensor modules 80 from breaking as a result of ink that has entered into the sensor housing portions 37.

In addition, sensor exposure holes 53, which pass through the reinforcement plate 50 in the thickness direction, are provided in the reinforcement plate 50 at positions that face the temperature sensors 81 of the temperature sensor modules 80. As a result of the sensor exposure holes 53 that are provided in the reinforcement plate 50, the temperature sensors 81 of the temperature sensor modules 80, which are housed in the sensor housing portions 37 of the holder 30, face the fixing plate 40 directly. Accordingly, it is possible for the temperature sensors 81 to directly measure the temperature of the Z2 side of the fixing plate 40, that is, the temperature in the vicinity of the nozzles 21, and therefore, it is possible to cause the pressure generation units to perform driving that is suited to the actual temperature of the ink discharged from the nozzles 21 by reducing the error between the actual temperature in the vicinity of the of the nozzles 21 and the temperature that the temperature sensors 81 measure. Incidentally, the sensor exposure holes 53 are formed to a size at which the reinforcement plate 50 covers portions of the substrates 82 other than the temperature sensors 81. As a result of this, due to a circumstance in which the rigidity of the reinforcement plate 50 is reduced being suppressed, it is possible for the reinforcement plate 50 to efficiently reinforce the fixing plate 40.

Embodiment 2

Figure 11:
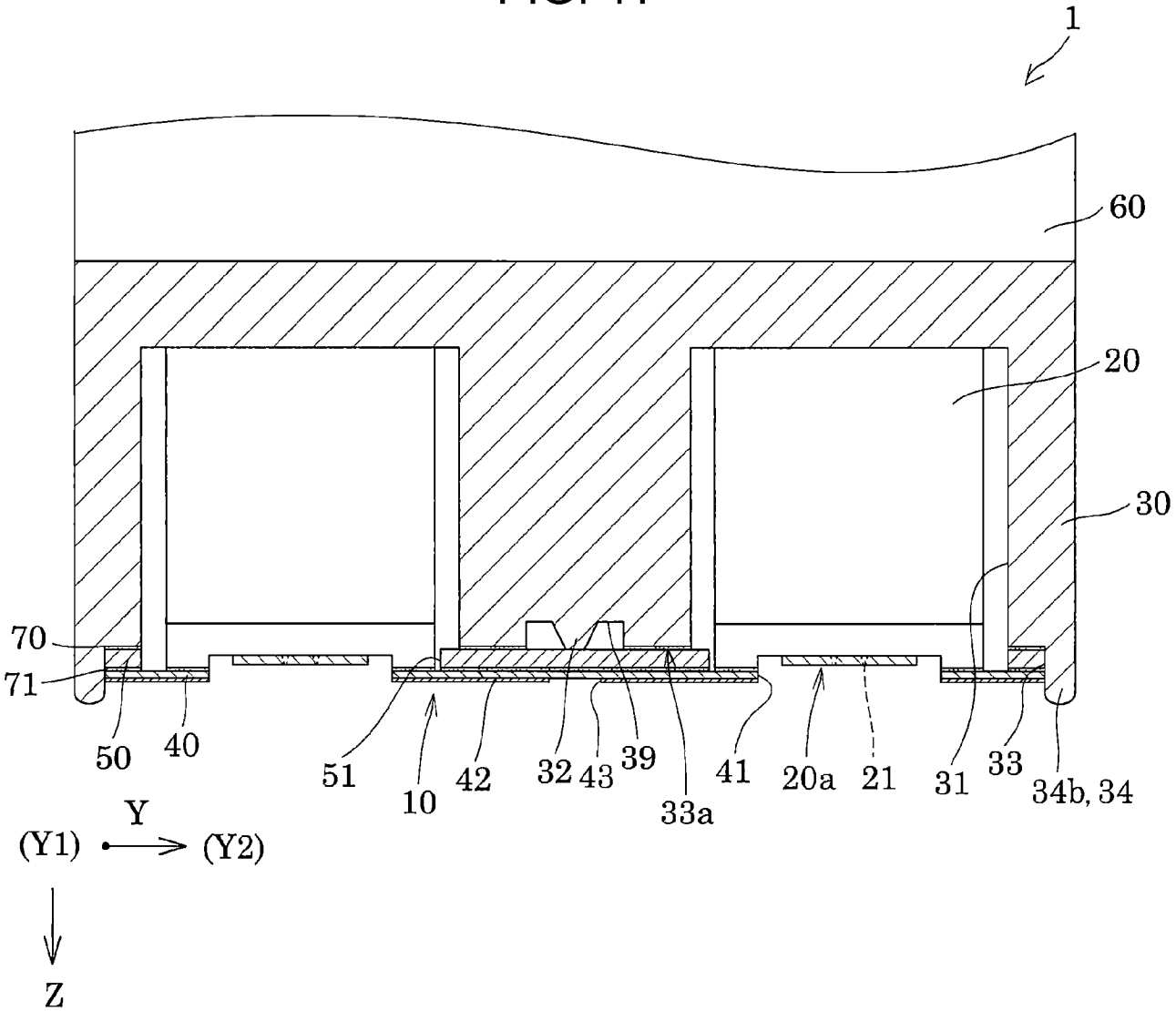
FIG. 11 is a main portion cross-sectional view of a head unit according to Embodiment 2 of the invention.

FIG. 11 is a main portion cross-sectional view of a head unit according to Embodiment 2 of the invention. Additionally, the same reference symbols are given to equivalent members to the above-mentioned embodiment, and overlapping description thereof will be omitted.

As shown in FIG. 11, a head unit 1 of the present embodiment is provided with a driving portion 20, a holder 30, a fixing plate 40, a reinforcement plate 50, and a flow channel member 60.

The fixing plate 40 and the reinforcement plate 50 are electrically connected to one another. In the present embodiment, the fixing plate 40 and the reinforcement plate 50 are electrically connected to one another using a conductive adhesive as a second adhesive 71 that connects the fixing plate 40 and the reinforcement plate 50. Additionally, the electrical connection of the fixing plate 40 and the reinforcement plate 50 is not limited to using a conductive adhesive, and for example, a configuration in which electrical connection is performed by causing a burr generated when forming an opening portion, which is an opening portion provided on one of the fixing plate 40 and the reinforcement plate 50, an opening edge portion of which comes into contact with the surface of the other of the fixing plate 40 and the reinforcement plate 50, to come into contact with the surface of the other of the fixing plate 40 and the reinforcement plate 50 may also be used. Incidentally, in the present embodiment, examples of an opening portion, which is an opening portion provided on one of the fixing plate 40 and the reinforcement plate 50, an opening edge portion of which comes into contact with the surface of the other of the fixing plate 40 and the reinforcement plate 50 include an opening portion 51 of the reinforcement plate 50, an insertion hole 52, a sensor exposure hole 53, and the like. In a case in which the fixing plate 40 and the reinforcement plate 50 are electrically connected to one another using a burr that is provided at the opening edge portion of an opening portion in this manner, it is possible to use a non-conductive adhesive as the second adhesive 71 that adheres the two components.

In addition, the holder 30 and the reinforcement plate 50 are provided electrically connected to one another. In the present embodiment, the holder 30 and the reinforcement plate 50 are electrically connected to one another by providing a groove portion 39 and a convex portion 32, which projects from the bottom surface of the groove portion 39, on the surface on the Z2 side of the holder 30, configuring such that the holder 30 and the reinforcement plate 50 are not adhered together inside the groove portion 39, and causing the tip end of the convex portion 32 to abut against the reinforcement plate 50. Naturally, the electrical connection of the holder 30 and the reinforcement plate 50 is not particularly limited to this configuration, and for example, may be an electrical connection that uses a conductive adhesive in the same manner as the electrical connection of the fixing plate 40 and the reinforcement plate 50, or may be an electrical connection that uses a burr formed at the opening edge portion of an opening portion.

As a result of the reinforcement plate 50 and the holder 30 in this manner, the fixing plate 40 is electrically connected to the holder 30 via the reinforcement plate 50. That is, the holder 30 being electrically connected to the fixing plate 40 and the support body 3 includes a case in which the holder 30 is directly connected to the fixing plate 40, and a case of being electrically connected to the fixing plate 40 via the reinforcement plate 50.

Even in such a configuration, it is possible to electrically connect the fixing plate 40 and the support body 3 to one another via the inner portion of the head unit 1, and therefore, it is possible to suppress a positional shift of the head unit 1 due to an external force. In addition, since it is possible to electrically connect the fixing plate 40 to the support body 3 via the inner portion of the head unit 1, it is possible to suppress grounding faults due to electrical connection faults.

OTHER EMBODIMENTS

Each embodiment of the invention is described above, but the basic configuration of the invention is not limited to the configurations mentioned above.

For example, in each of the above-mentioned embodiments, a configuration in which the reinforcement plate 50 is provided is used, but the invention is not particularly limited to this configuration, and the reinforcement plate 50 need not necessarily be provided. Even in this case, as a result of electrically connecting the holder 30 and the fixing plate 40 to one another, it is possible to ground the fixing plate 40 by electrically connecting the fixing plate 40 to the support body 3 via the holder 30.

In addition, in the above-mentioned embodiments, a configuration in which the entirety of the support body 3 is formed by using a conductive material is illustrated by way of example, but the invention is not particularly limited to this configuration, and in the support body 3, as long as at least continuous portions including both portions that come into contact with the holder 30 of the head unit 1 and portions that are grounded are formed by using a material having a conductive property, an insulating material may be used in other portions. In the same manner, a configuration in which the entirety of the holder 30 is formed by using a conductive material is illustrated by way of example, but the invention is not particularly limited to this configuration, and it is sufficient as long as at least continuous portions including both the convex portion 32 and portions that come into contact with the support body 3 are formed by using a conductive material.

Furthermore, in the above-mentioned embodiments, a configuration in which a flat plate form member is used as the fixing plate 40 is shown, but the invention is not particularly limited to this configuration, and for example, the four sides of the fixing plate 40 may be configured so that side wall portions that are bent toward the side surfaces of the holder 30 are provided.

In addition, in the above-mentioned embodiments, a so-called line-type recording apparatus, in which the head units 1 are fixed to the apparatus main body 7 and which performs printing by only transporting the recording sheets S, is illustrated by way of example of the ink jet type recording apparatus I, but the invention is not particularly limited to this configuration, and for example, it is also possible to apply the invention to a so-called serial type recording apparatus, in which the head units 1 are mounted in a support body such as a carriage that moves in the first direction X, which intersects the second direction Y, which is the transport direction of the recording sheets S, and which performs printing while moving the supply and the head units 1 in the first direction X.

In addition, in each of the above-mentioned embodiments, a configuration in which the plurality of driving portions 20 are disposed in the holder 30 in a staggered manner along the first direction X is used, but the invention is not particularly limited to this configuration, and the driving portions 20 may be arranged in parallel in either the first direction X or the second direction Y, or in addition, the driving portions 20 may be arranged in parallel in a direction that intersects both the first direction X and the second direction Y.

Additionally, in the above-mentioned embodiments, description is given by using an ink jet type recording head unit as an example of a liquid ejecting head unit and an ink jet type recording apparatus as an example of a liquid ejecting apparatus, but, the invention was generally devised for all liquid ejecting head units and liquid ejecting apparatuses, and naturally, can also be applied to liquid ejecting head units and liquid ejecting apparatuses that eject liquids other than ink. Examples of such other liquid ejecting heads include various recording head units that are used in image recording apparatuses such as printers, color material ejecting head units that are used in the manufacture of color filters such as liquid crystal displays, electrode material ejecting head units that are used in electrode formation such as organic EL displays, Field Emission Displays (FED) and the like, living organic material ejecting head units that are used in the production of biochips and the like, and it is also possible to apply the invention to liquid ejecting apparatuses that are provided with such liquid ejecting head units.

What is claimed is:

1. A liquid ejecting head unit for ejecting a liquid from a nozzle, the liquid ejecting head unit comprising:

a driving portion that includes an ejection surface on which a plurality of nozzles for ejecting the liquid are formed;

a fixing plate to which a plurality of the driving portions are fixed; and a holder, wherein the holder is fixed to a support body, which supports the liquid ejecting head unit, and the holder has a conductive property that electrically connects the support body and the fixing plate to one another, and wherein the driving portion is housed between the fixing plate and the holder, wherein the holder includes a convex portion that abuts against the fixing plate, and an adhering surface for adhering to the fixing plate, and wherein, in the fixing plate, a liquid repelling layer is not formed at a position that abuts against the convex portion.

2. The liquid ejecting head unit according to claim 1, wherein the holder houses the plurality of driving portions between itself and the fixing plate.

3. The liquid ejecting head unit according to claim 2, wherein the holder includes a through hole that passes therethrough in the direction orthogonal to the ejection surface, and wherein the plurality of driving portions are disposed at positions at which the through hole is interposed therebetween when viewed in the direction orthogonal to the ejection surface.

4. The liquid ejecting head unit according to claim 3, wherein the holder is open on the side of the fixing plate and includes a concave-shaped sensor housing portion that houses a temperature sensor, which measures a temperature of the fixing plate, and wiring connected to the temperature sensor is disposed through the through hole.

5. The liquid ejecting head unit according to claim 1, wherein the holder is at a position at which the fixing plate is provided in the direction orthogonal to the ejection surface.

6. The liquid ejecting head unit according to claim 5, wherein the holder includes a portion that projects from the fixing plate, and a portion that does not project from the fixing plate, in the direction orthogonal to the ejection surface, wherein the portion that projects is provided in a direction that intersects a relative movement direction of an ejection target medium and the liquid ejecting head unit, and wherein the portion that does not project is provided in the relative movement direction of the ejection target medium and the liquid ejecting head unit.

7. The liquid ejecting head unit according to claim 1, wherein a strength of the holder is greater than a strength of the fixing plate.

8. The liquid ejecting head unit according to claim 1, further comprising:

a reinforcement plate stacked on the fixing plate, and having a strength greater than a strength of the fixing plate, which is conductive, wherein the holder is electrically connected to the fixing plate via the reinforcement plate.

9. The liquid ejecting head unit according to claim 1, wherein a strength of the holder is greater than a strength of the fixing plate.

10. The liquid ejecting head unit according to claim 1, further comprising:

a reinforcement plate stacked on the fixing plate, and having a strength greater than a strength of the fixing plate, wherein the holder is fixed to the fixing plate via the reinforcement plate.

11. The liquid ejecting head unit according to claim 1, wherein the holder includes a portion that does not project from the fixing plate in the direction orthogonal to the ejection surface, wherein the portion that projects is provided in a direction that intersects a relative movement direction of an ejection target medium and the liquid ejecting head unit, and wherein the portion that does not project is provided in a relative movement direction of an ejection target medium and the liquid ejecting head unit.

12. A liquid ejecting apparatus comprising:

a plurality of the liquid ejecting head units according to claim 1; and the support body that supports the plurality of liquid ejecting head units by using the holder.

13. A liquid ejecting apparatus comprising: a plurality of the liquid ejecting head units according to claim 1; and the support body that supports the plurality of liquid ejecting head units by using the holder.

14. A liquid ejecting apparatus comprising:

a plurality of the liquid ejecting head units according to claim 1; and the support body that supports the plurality of liquid ejecting head units by using the holder.

15. A liquid ejecting apparatus comprising:

a plurality of the liquid ejecting head units according to claim 2; and the support body that supports the plurality of liquid ejecting head units by using the holder.

16. A liquid ejecting apparatus comprising:

a plurality of the liquid ejecting head units according to claim 1; and the support body that supports the plurality of liquid ejecting head units.

17. A liquid ejecting head unit for ejecting a liquid from a nozzle, the liquid ejecting head unit comprising:

a driving portion that includes an ejection surface on which a plurality of nozzles for ejecting the liquid are formed;

a fixing plate to which a plurality of the driving portions are fixed; and a holder, wherein (i) the holder includes an edge portion that projects in a direction orthogonal to the ejection surface and a housing portion that houses the plurality of driving portions, and (ii) the driving portion is housed in a space between the housing portion and the fixing plate, wherein the driving portion is housed between the fixing plate and the holder, wherein the holder includes a convex portion that abuts against the fixing plate, and an adhering surface for adhering to the fixing plate, and wherein, in the fixing plate, a liquid repelling layer is not formed at a position that abuts against the convex portion.

18. The liquid ejecting head unit according to claim 17, wherein the edge portion includes a first edge portion that does not project further than the fixing plate, and a second edge portion that projects further than the fixing plate.

19. A liquid ejecting apparatus comprising:

a plurality of the liquid ejecting head units according to claim 17; and the support body that supports the plurality of liquid ejecting head units.

20. A liquid ejecting head unit for ejecting a liquid from a nozzle, the liquid ejecting head unit comprising:

a driving portion that includes an ejection surface on which a plurality of nozzles for ejecting the liquid are formed;

a fixing plate to which a plurality of the driving portions are fixed; and a holder that satisfies Condition 1 and/or Condition 2 below, wherein, in Condition 1, the holder is fixed to a support body, which supports the liquid ejecting head unit, and the holder has a conductive property that electrically connects the support body and the fixing plate to one another, wherein, in Condition 2, the holder includes a portion that projects from the fixing plate in a direction orthogonal to the ejection surface, and houses the plurality of driving portions, wherein the holder includes a convex portion that abuts against the fixing plate, and an adhering surface for adhering to the fixing plate, and wherein, in the fixing plate, a liquid repelling layer is not formed at a position that abuts against the convex portion.

21. A liquid ejecting apparatus comprising:

a plurality of the liquid ejecting head units according to claim 20; and the support body that supports the plurality of liquid ejecting head units by using the holder.

* * * * *